US005740883A

United States Patent [19]

Trank

[11] Patent Number: 5,740,883

[45] Date of Patent: Apr. 21, 1998

[54] TOOL ACCESSORY FOR LADDER

[76] Inventor: Robert D. Trank, 331 SE. 8th St., Pompano Beach, Fla. 33060

[21] Appl. No.: 790,220

[22] Filed: Feb. 3, 1997

[51] Int. Cl.[6] ..... E06C 7/14

[52] U.S. Cl. ..... 182/129; 248/210

[58] Field of Search ..... 182/129; 248/210, 248/238; 206/373

[56] References Cited

U.S. PATENT DOCUMENTS

| | | | |
|---|---|---|---|
| 368,426 | 8/1887 | Ruttmann | 248/188.5 |
| 3,642,239 | 2/1972 | Zeiler | 211/71 X |
| 3,842,936 | 10/1974 | DeLuca . | |
| 4,261,435 | 4/1981 | Winter . | |
| 4,310,134 | 1/1982 | Schopp et al. . | |
| 4,356,854 | 11/1982 | McGee . | |
| 4,418,793 | 12/1983 | Brent . | |
| 4,653,713 | 3/1987 | Hamilton . | |
| 4,730,802 | 3/1988 | Chatham . | |
| 4,874,147 | 10/1989 | Ory | 248/210 |
| 5,505,302 | 4/1996 | Ferley . | |
| 5,544,718 | 8/1996 | Schumacher . | |
| 5,564,566 | 10/1996 | Lamb | 206/373 |
| 5,582,269 | 12/1996 | Gugel | 182/129 |

*Primary Examiner*—Alvin C. Chin-Shue
*Attorney, Agent, or Firm*—Malin, Haley, DiMaggio & Crosby

[57] ABSTRACT

A height adjustable ladder tool accessory box for holding tools, hardware, supplies, paint containers, and the like for use on ladders, including step ladders and extension type ladders. The invention includes a tool and hardware box which removably attaches to a pair of support members. In one embodiment, the support members removably and adjustable slide into a pair of mounting brackets that attach to either side of a step ladder. In another embodiment, the tool accessory box is supported by a pair of support brackets that removably attach to either side of an extension ladder. The tool accessory box includes a removable opening lid that covers internal compartments for storing an assortment of tools, hardware, and supplies. The lid includes a series of external concentric raised rings to hold standard sized paint containers, and has a raised perimeter to retain articles set on the lid. The tool accessory box includes a handle and a plurality of external tool holders.

8 Claims, 7 Drawing Sheets

TOOL ACCESSORY FOR LADDER

BACKGROUND OF THE INVENTION

1. Field of the Invention

This invention relates to a ladder tool and paint can accessory, and more particularly to a variable height tool and paint can accessory for holding tools, supplies, hardware, paint containers, and the like for use on ladders, permitting easier access for the user.

2. Description of Related Art

Ladders are typically used to assist individuals in performing tasks at elevated heights beyond one's unaided reach. Depending on the task being performed, the user may be required to climb up and down the ladder many times, carrying supplies, tools, and/or hardware to the elevated work site. For example, painting ceilings and upper wall sections generally must be accomplished on a ladder.

Step ladders of the known type that include a folding A-frame structure, generally include a top step that, while not intended for this purpose, can accommodate a few tools and/or supplies. The top step normally cannot contain very many items, nor does it include any mechanism to secure items that may be placed thereon.

Step ladders may be provided with an extendable tool platform on the side of the A-frame opposite the steps. The tool platform generally does not include any securing mechanism to hold tools or supplies in place. In addition, the tool platform, and often the top step, are too low for the individual to comfortably reach for items when performing elevated work, and may require constant bending. For example, if the individual is painting overhead, constant dipping of a paint brush into a paint can placed on the top step or tool platform of a step ladder can easily result in constant reaching and/or bending, and often results in paint drips and splatters everywhere.

Extension type ladders, as known in the art, do not include any provisions for holding tools or accessories.

Constant climbing of a ladder and/or constant reaching and bending can be extremely time consuming and fatiguing. Placing tools and supplied in a loose condition on the top of a ladder can be unstable, and possibly dangerous.

Attempts to provide a tool carrier which solves the above mentioned problems have been attempted. Many of the attempts consist essentially of a tray or tool box that attaches to the top step of a step ladder. While this approach addresses some of the problems associated with securing tools, supplies, and the like, it does not provide the height adjustability necessary to prevent bending and reaching for many individuals.

An attempt at providing height adjustability of a utility shelf for step ladders is disclosed in U.S. Pat. No. 4,418,793, issued to Brent (the '793 patent). The device disclosed in the '793 patent is a small platform attached to one side of a step ladder. Because the utility shelf is attached to one side of the ladder, the shelf is unsuitable, and probably unsafe, for large or relatively heavy items. When the device of the '793 patent is loaded, the one side only attachment provision could cause the ladder to tip over.

An attempt to solve the apparent problems of the '793 patent is disclosed in U.S. Pat. No. 5,544,718 issued to Schumacher (the '718 patent). The device of the '718 patent is attached to a step ladder by two retraction tubes which are each mounted on the ends of the steps of the ladder. Because the device of the '718 patent is mounted in two locations on the ladder, the device of the '718 patent is clearly more stable than the single point mounting shelf of the '793 patent. However, the device of the '718 patent introduces another problem. The device of the '718 patent attaches to the steps of a step ladder thereby reducing the available area that is intended for the individual to stand. The retraction tubes may interfere with the individual's footing while on the ladder, and therefore introduces additional risk for anyone using a ladder equipped with the device.

What is needed is a relatively lightweight tool and accessory box, that is easily adjustable in height, and that solves the above mentioned problems.

SUMMARY OF THE INVENTION

The present invention is a height-adjustable ladder tool accessory box for holding tools, hardware, supplies, and the like for use on various ladders including step ladders and extension type ladders. The invention includes a tool and hardware box which removably attaches to a pair of support members. In one embodiment, the support members removably and adjustably slide into a pair of mounting brackets that attach to either side of a step ladder. In another embodiment, the tool accessory box is supported by a pair of support brackets that removably attach to either side of an extension ladder.

The tool accessory box of the present invention includes a hinged and removable lid with latches shut to ensure positive closure. When closed, the lid can include a series of preformed concentric circular rings sized to fit and retain standard sized paint containers, and a raised perimeter to retain loose parts. When opened, the interior of the box can include a plurality of divided storage bins of various sizes to hold an assortment of tools and hardware. The box can include an exterior tool holder, and a handle for easy transporting to and from the work site and up and down the ladder.

In the embodiment mentioned above, for applications on a step ladder, a pair of support members slidably fit into a pair of brackets which attach to the sides of a step ladder. Each support member includes a series of evenly spaced downward facing wedge shaped protruding tabs. The wedge shaped tabs are movable and deflect flush with the support member when depressed. The wedge shaped tabs are resilient and have "memory" such than after being depressed and released, they will return to their original protruding position.

When a support member is slid into the mounting bracket, the wedge shaped tabs are each in turn manually deflected to position the support member. If the support member is being slid in the upward direction, a portion of the mounting bracket itself will deflect each wedge shaped tab in turn. The wedge shaped tabs are then released in turn by an open area in the bracket where the wedge shaped tab protrudes outward of the support member. The support member can thus be slid into the mounting bracket deflecting each wedge shaped tab in turn until the desired height is reached. Upon reaching the desired height, the support member retains that height by the downward facing protruding wedge shaped tab resting on a portion of the mounting bracket. Both support members have evenly and equally spaced wedged shaped tabs so that each support member can rest at the same height within each mounting bracket.

The support members can be adjusted at any time by depressing the wedge shaped tabs and sliding the support member in relation to the mounting bracket in the manner described above. When adjusting upward, a portion of the mounting bracket will depress each wedge shaped tab in turn. When adjusting downward, the wedge shaped tabs must be manually depressed and the support member slid downward in relation to the mounting bracket.

Once the support members are positioned at the correct height, a pair of receiving apertures on the tool accessory box of the present invention are slid onto each support member. The tool accessory box is held in place by suitably positioned shoulders on each support member which are larger than the apertures in the tool accessory box into which the support member is slid. If necessary, final height of the tool accessory box can be adjusted, while the tool accessory box is in place on the support members, by-adjusting the support members' position in each mounting bracket following the procedures mentioned herein above.

The support members can include a suitably positioned mount for a removable bar or tubular member which can be used to hold a roll of paper towels or the like.

The present invention can be made of any suitable lightweight sturdy material such as molded plastic.

In the embodiment mentioned above, for applications on an extension ladder, the tool accessory box is used with a pair of support brackets suitable for attachment to an extension ladder, as opposed to the support members and mounting brackets for use on a step ladder as described herein above. The support brackets for use on an extension ladder fit into the apertures on the tool accessory box in the same manner as the support members used on the step ladder. However, instead of the support members sliding into mounting brackets attached to the ladder, the support brackets are shaped to partially wrap around or rest on one of the ladder's steps and are held in place by engagement with either the next lower step, or alternately with an edge of the side of the ladder.

Accordingly, it is an object of the present invention to provide a tool, paint container, and accessory holder for use on a ladder that is adjustable in height.

It is another objective of the present invention to provide a tool, paint container, and accessory holder for use on a ladder that includes a removable lid, an exterior tool holder rack, and a handle for portability.

It is still another objective of the present invention to provide a tool, paint container, and accessory holder for use on a ladder that is easily adjusted in height, and includes a removable paper towel rack.

In accordance with these and other objects which will become apparent hereinafter, the instant invention will now be described with particular reference to the accompanying drawings.

DESCRIPTION OF TEE PREFERRED EMBODIMENTS

Figure 1:
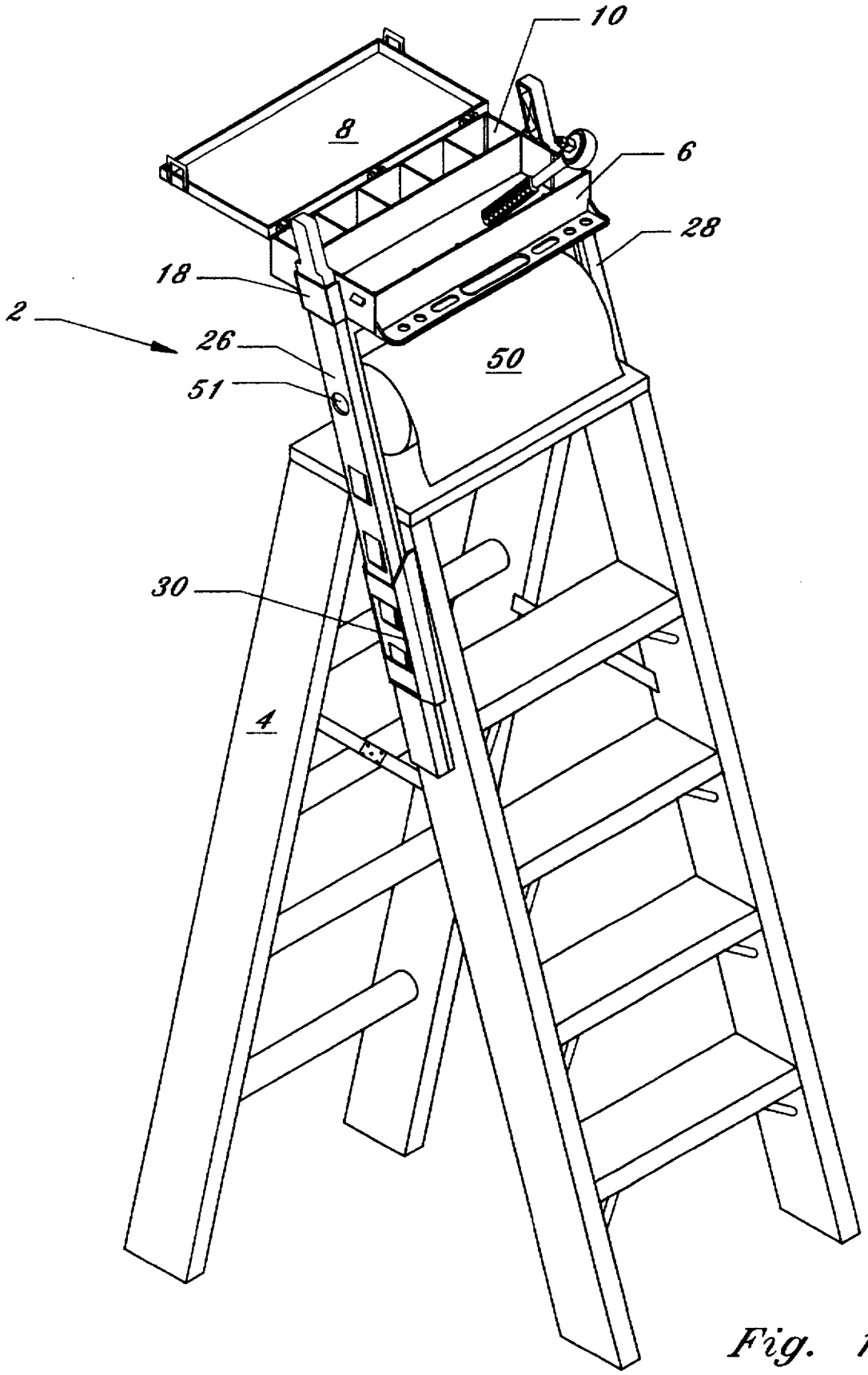
FIG. 1 is a perspective view of the present invention installed on a step ladder.

Referring now to the drawings, and in particular FIG. 1, one embodiment of the present invention, shown generally as 2, is attached to step ladder 4. Tool accessory box 6 is shown with removable lid 8 in the open position exposing a plurality of internal compartments 10 of various sizes to hold various tools, hardware, supplies, and the like, as can be better seen in FIG. 2. Lid 8 includes a pair of latches 11 and 12, which engage a pair of raised catches, one of which is shown as 13. Tool accessory box 6 includes a suitably positioned handle 14 and a plurality of different sized tool holders 16. Handle 14 provides for easy portability of box 6 when transporting to and from the work site, and up and down the ladder.

Figure 3:
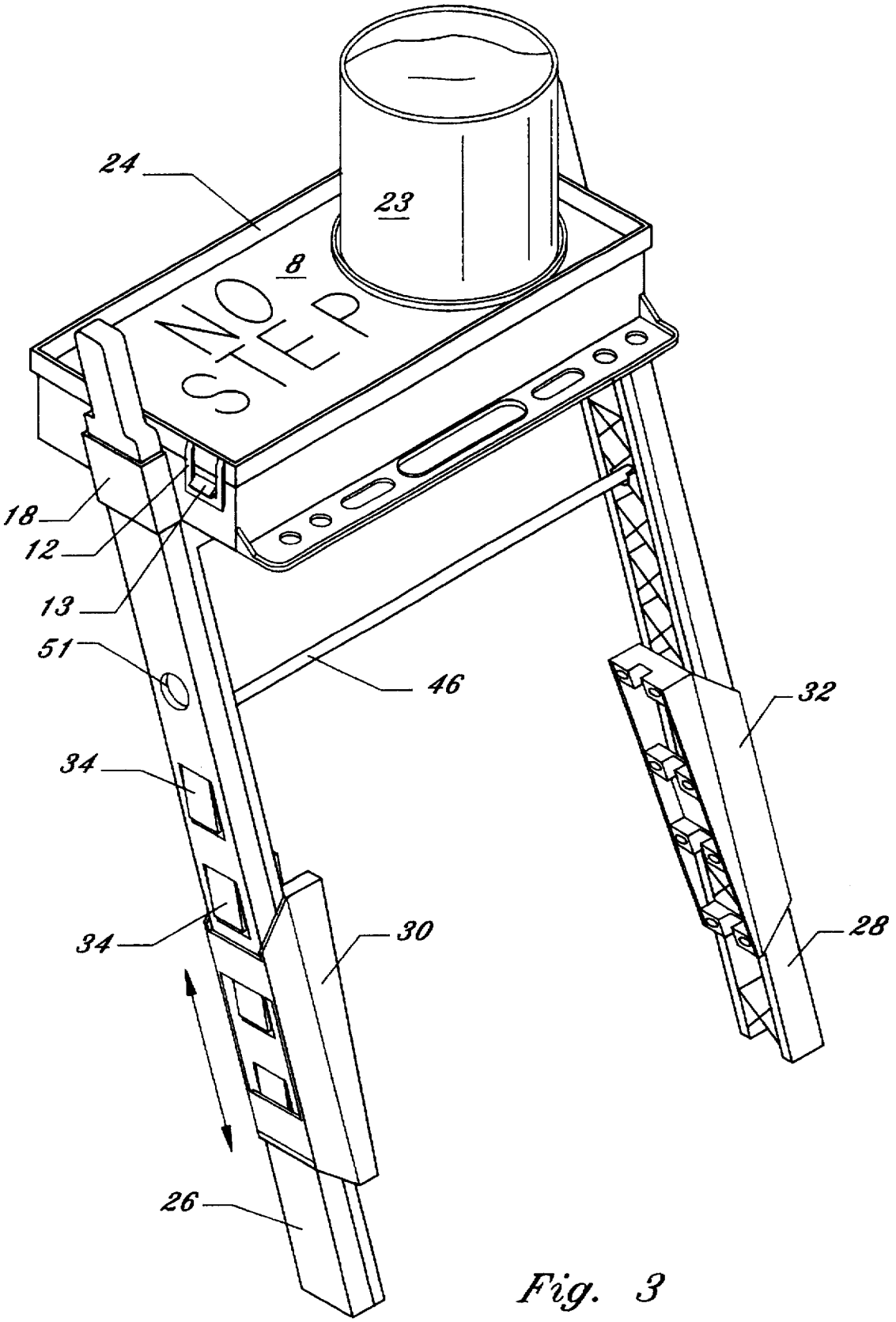
FIG. 3 is a perspective view of the present invention with the lid closed.
Figure 4:
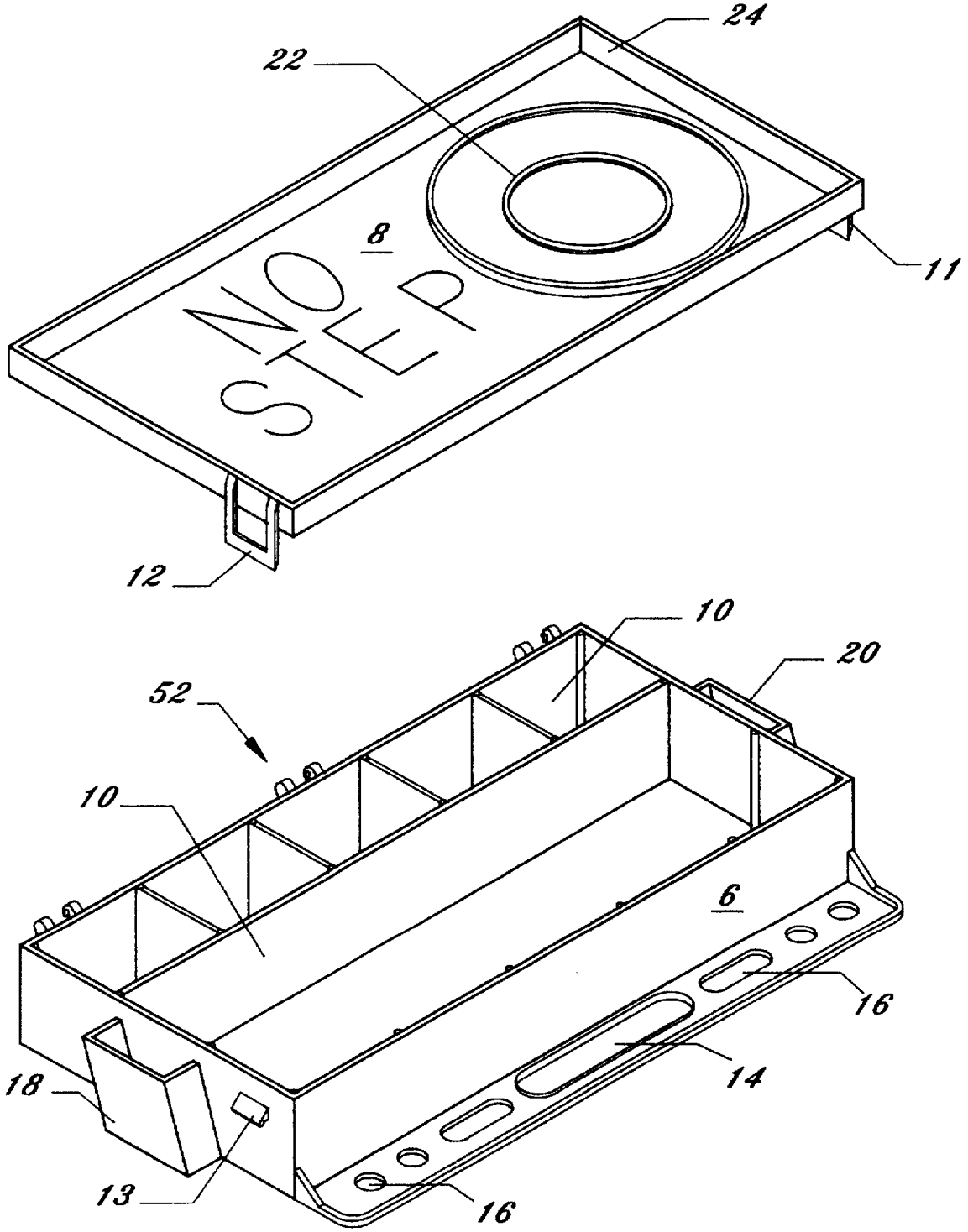
FIG. 4 is a perspective view of the tool accessory box with the lid removed.

Referring now to FIG. 3, lid 8 is shown in the closed position, with latch 12 engaged with catch 13. Referring also to FIG. 4, lid 8 includes concentric rings 22, which are sized to grip standard paint cans, such as can 23. Lid 8 can further include perimeter lip 24, to retain loose parts and tools when set on lid 8.

Figure 5:
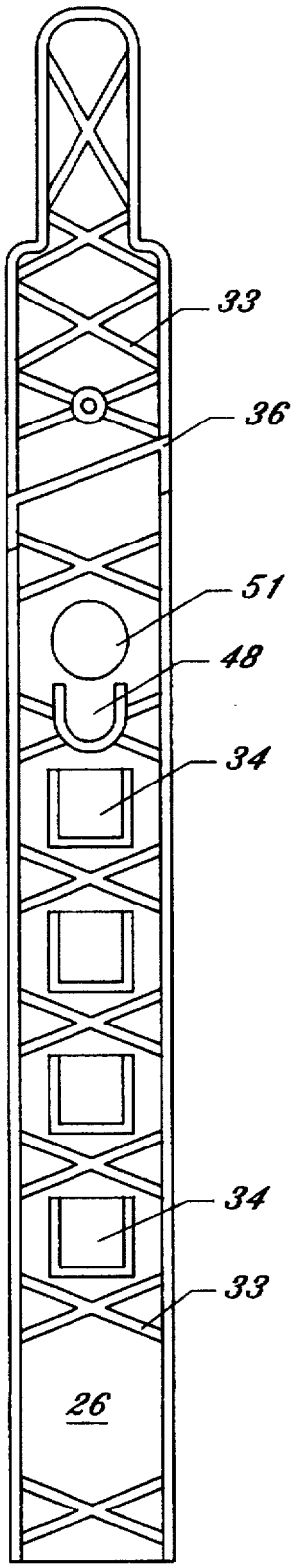
FIGS. 5 and 6 are side elevational views of the support members.
Figure 6:
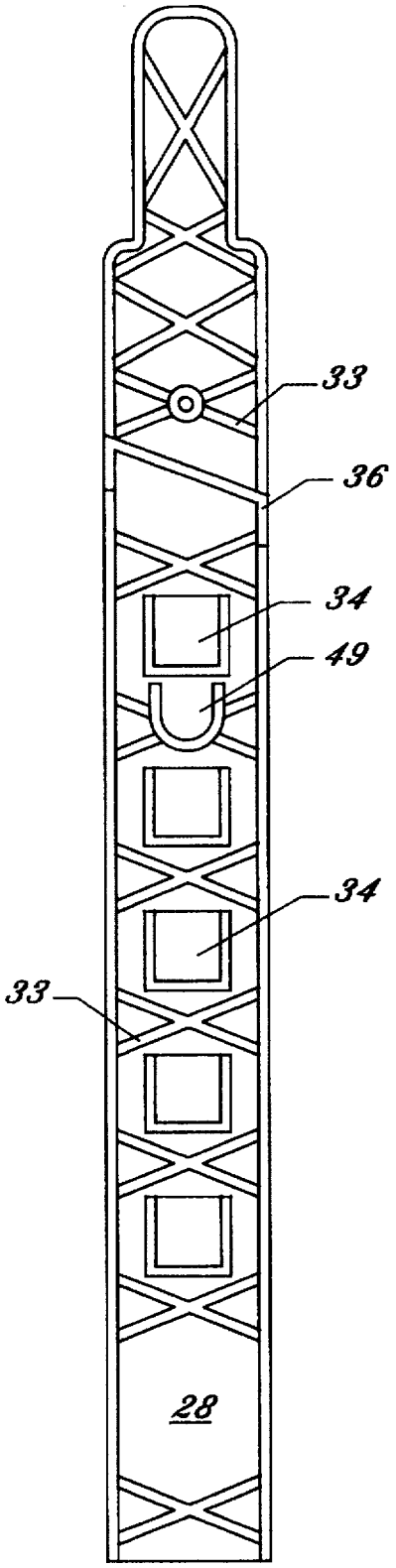

Tool accessory box 6 includes a pair of apertures 18 and 20, as best seen in FIG. 4, which slide onto a pair of support members 26 and 28. Support members 26 and 28 slide into mounting brackets 30 and 32 respectively, which are mounted to either side of step ladder 4. Support members 26 and 28 are shown in FIGS. 5 and 6 respectively. Support members 26 and 28 may include a plurality of strength members 33, especially if support members 26 and 28 are made of molded plastic or similar material.

Figure 7:
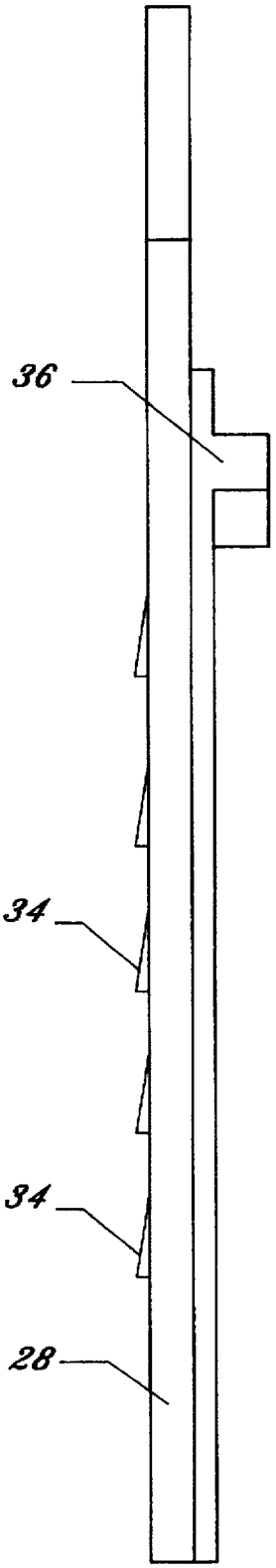
FIG. 7 is a front elevational view of the support member of FIG. 6.

When tool accessory box 6 is slid onto support members 26 and 28, through apertures 18 and 20, box 6 rests against shoulders on support members 26 and 28, one of which is shown as 36, in FIG. 7.

Support members 26 and 28 include a series of preselected and evenly spaced downward facing wedge shaped tabs 34. As seen in FIG. 7, tabs 34 project outward of support members 26 and 28, but can be depressed flush with the surface of each support member. Tabs 34 are biased in the outward projecting position by any suitable manner, such as being resilient and having "memory". Once depressed and released, tabs 34 will automatically return to the outward projecting position seen in FIG. 7.

Figure 8:
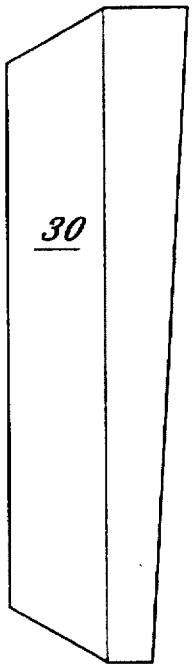
FIGS. 8 and 9 are side and rear elevational views respectively of a mounting bracket of the present invention.
Figure 9:
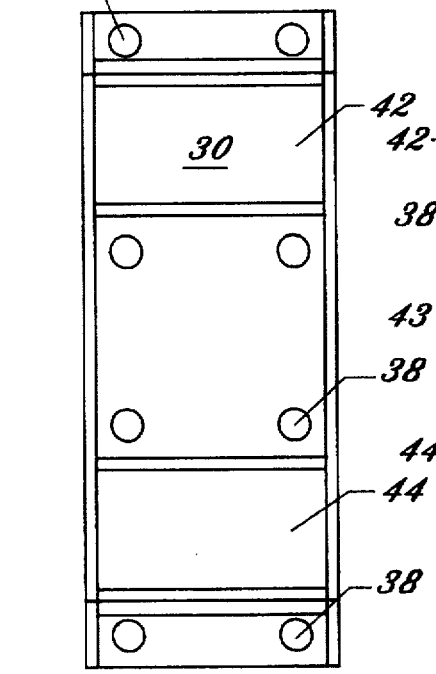
Figure 10:
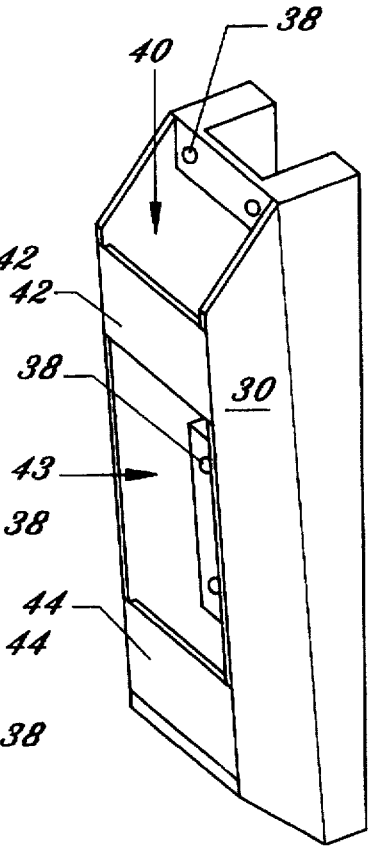
FIG. 10 is a perspective view of the mounting bracket of FIGS. 8 and 9.

Referring now to FIGS. 8–10, mounting bracket 30 is shown. The description that follows mirrors identical bracket 32, and support member 28, and will not be repeated. Mounting bracket 30 can be attached to ladder 4 by suitable fasteners passing through a plurality of apertures 38 and into ladder 4.

Figure 2:
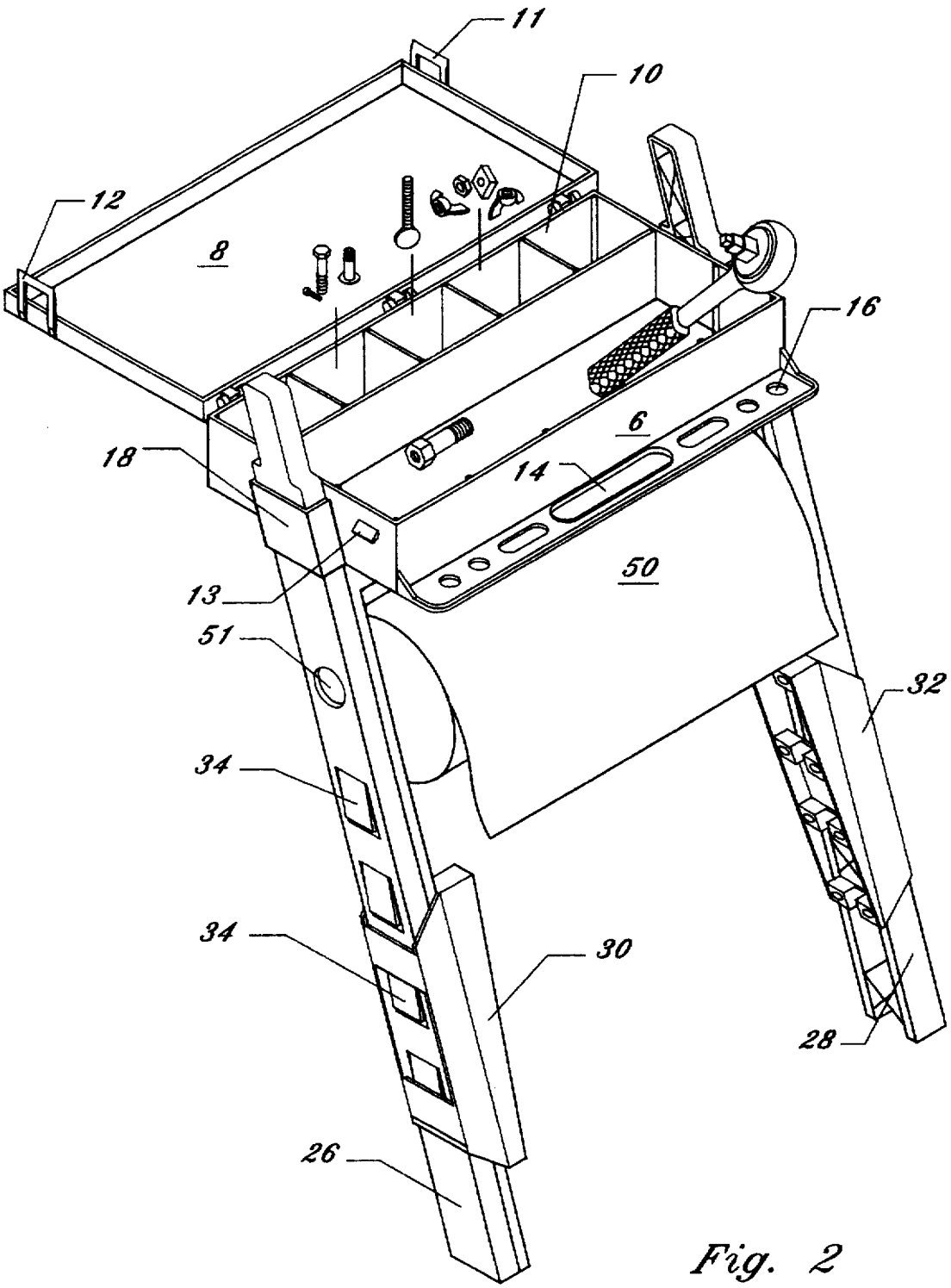
FIG. 2 is a perspective view of the present invention with the lid of the tool accessory box open.

Referring now to FIG. 10 and any of FIGS. 1–3, support member 26 is slid into mounting bracket 30 through aperture 40. The first of the series of wedge shaped tabs 34, will rest on section 42 of bracket 30, to provide a first height adjustment position.

Each wedge shaped tab 34 can be depressed flush with support member 26, permitting each wedge shaped tab 34 to slide past section 42 and into open area 43 of bracket 30. As support member 26 is slid further into bracket 30, the first wedge shaped tab 34 is depressed and allowed to slide past section 42. The first wedge shaped tab 34, will pass through open area 43 and be stopped by section 44, to provide a second height adjustment position.

The first wedge shaped tab 34, now resting on section 44, can be depressed flush with support member 26, permitting the first wedge shaped tab 34 to slide past section 44. The next or second wedge shaped tab 34 on support member 26 will now be stopped by section 42, providing a third height adjustment position.

The second wedge shaped tab 34 on support member 26 can be depressed flush with support member 26 and slid past section 42, into open area 43 and will be stopped by section 44, providing a fourth height adjustment position.

If support member 26 is slid in the upward direction in relation to mounting bracket 30, sections 44 and 42 will automatically depress each wedge shaped tab 34 in turn, permitting support member 26 to slide upward until the desired height is reached without the need to manually depress each wedge shaped tab 34.

Mounting brackets 30 and 32 can include any number of sections such as 42 and 44. Two sections are selected herein as example only and not to be limiting. The only requirement is there be at least one section suitable for positioning the support members 26 and 28.

The above described height adjustment is identical for support member 28 and mounting bracket 32, and proceeds until both support members 26 and 28 are at the desired height. Tool accessory box 6 is then placed on support members 26 and 28, at apertures 18 and 20 respectively, and will rest on a shoulder on each support member 26 and 28, one of which is shown as 36 in FIG. 7.

Referring now to FIG. 3, 5, and 6, bar or tubular member 46 is held in place by U-shaped brackets 48 and 49, to form a rack or holder for supplies, such as paper towels 50, as seen in FIGS. 1 and 2. Bar 46 is removable through aperture 51 in support member 26.

Figure 11:
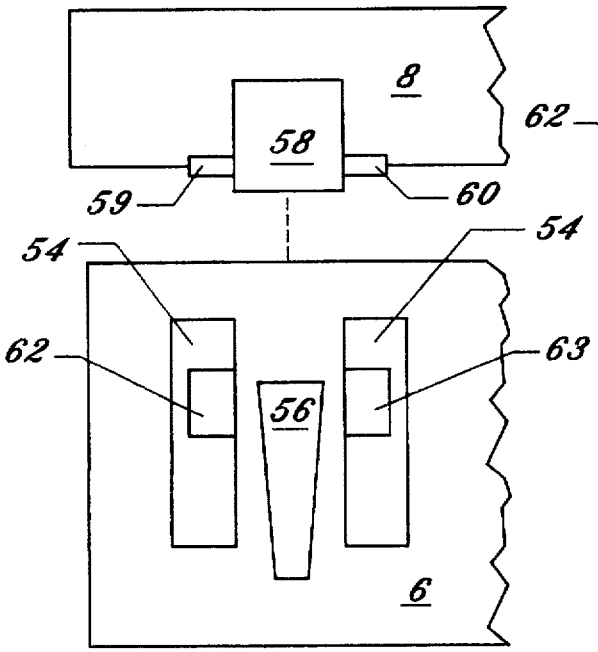
FIG. 11 shows one of the hinges of the removable lid with the lid removed.
Figure 12:
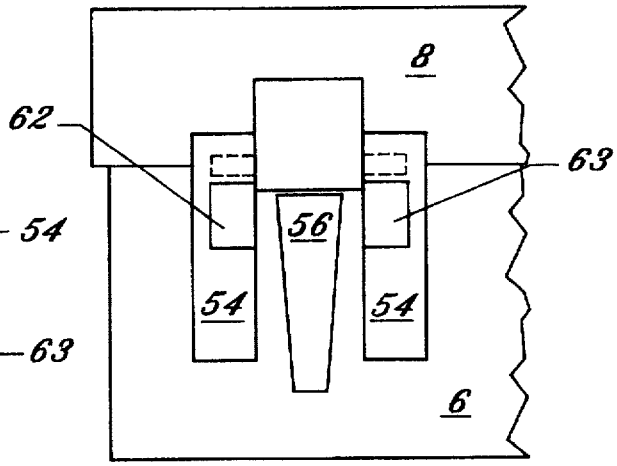
FIG. 12 shows the hinge of FIG. 11 with the lid in place.

Referring to FIG. 4, 11, and 12, lid 8 is removable by disengaging hinges 52. Hinges 52 include a pair of sockets 54 and a depressible locking tab 56 attached to box 6. Lid 8 includes T-shaped member 58 which has opposed protruding bars 59 and 60. Bars 59 and 60 slide in to sockets 54 through openings 62 and 63 and are held in place by locking tab 56. To remove lid 8, locking tab 56 is depressed and bars 59 and 60 are slid out of openings 62 and 63, respectively, separating lid 8 from box 6.

Figure 14:
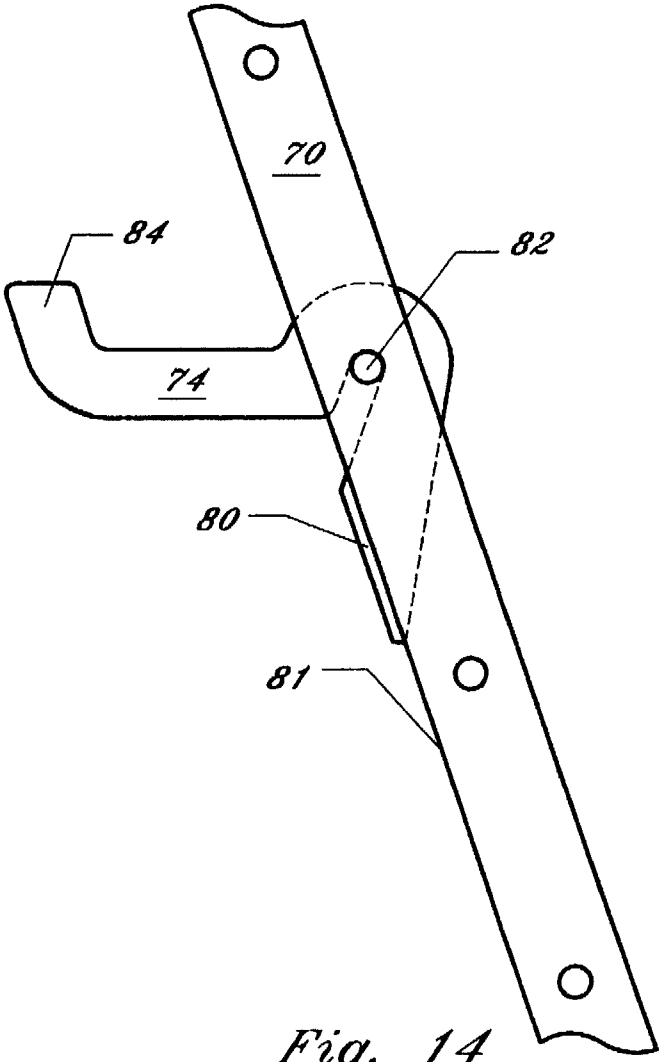
FIG. 14 shows an alternate embodiment of the embodiment of FIG. 13.
Figure 13:
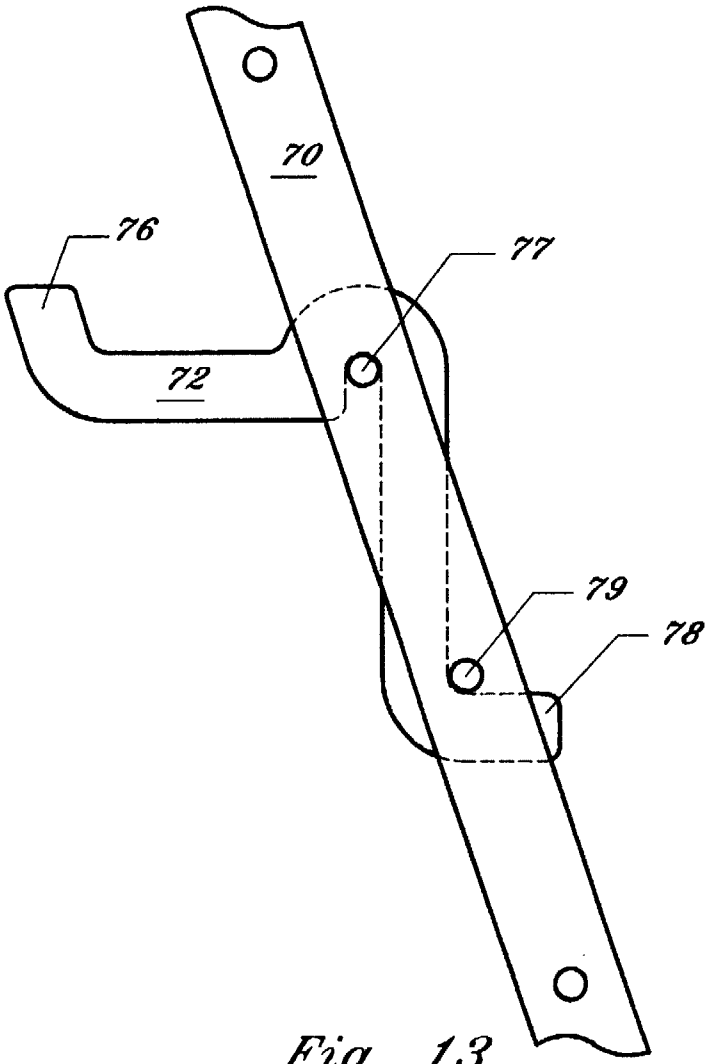
FIG. 13 shows an alternate embodiment of the support members of the present invention.

Referring now to FIGS. 13 and 14, an alternate embodiment of the present invention is shown for use on an extension type ladder 70. The tool accessory box for the alternate embodiment is identical that described herein above, the difference is the support members and mounting brackets are replaced by a pair of preshaped support brackets, one of which is shown as 72, and alternately 74. Support bracket 72 includes section 76 which inserts into aperture 18 on tool accessory box 6. Support bracket rests on step 77 and includes section 78 which engages around step 79 to support the weight of tool accessory box 6.

Alternately, support bracket 74 rests on step 82 and includes flared portion 80 that engages edge 81 of ladder 70 to support tool accessory box 6. Tool accessory box 6 rests on section 84 of support bracket 74 in a manner similar to support bracket 72.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A tool and accessory box for use on a ladder comprising:

a container body having a plurality of side walls and a floor, joined together, and a removable and openable lid, said lid movable between an open position to access an interior of said container body, and a closed position to form an essentially horizontal platform;

a pair of elongated support members, each of said pair of elongated support members including a plurality of evenly spaced downward facing wedged shaped protruding members, each of said plurality of evenly spaced wedged shaped protruding members manually movable to a nonprotruding position essentially flush with a surface of each of said elongated support members, each of said plurality of evenly spaced wedged shaped protruding members being biased in the protruding position;

a pair of mounting brackets, each of said pair of mounting brackets including means for attaching to a side of a ladder, said pair of mounting brackets being mountable on opposite sides of the ladder and external to the steps, each of said pair of mounting brackets further including an essentially vertical aperture sized to receive one of said elongated support members, each of said mounting bracket essentially vertical apertures including at least one fixed horizontal portion positioned to engage a lower edge of each of said wedge shaped protruding members to adjustably position each of said elongated support members in a plurality of fixed positions in relation to each of said mounting brackets;

each of said elongated support members being slidable in relation to each of said mounting brackets when each of said plurality of said wedged shaped protruding members are manually moved to said flush position when adjacent said at least one fixed horizontal portion of said essentially vertical aperture;

said container body including a pair of apertures sized and positioned to receive one each of said pair of elongated support members;

each of said pair of elongated support members having a prepositioned shoulder to support said container body when said elongated support members are received within said pair of apertures on said container body;

wherein said plurality of fixed positions of each of said elongated support members within each of said mounting bracket essentially vertical apertures provides a plurality of height positions for said container body relative to the ladder.

2. A tool and accessory box as in claim 1 wherein said container body includes a plurality of internal compartments accessible when said lid is in said open position.

3. A tool and accessory box as in claim 1 wherein said lid in said closed position further including a raised perimeter and at least one presized raised circular portion.

4. A tool and accessory box as in claim 1 wherein said lid includes a disconnectable hinge means.

5. A tool and accessory box as in claim 1 wherein said lid includes means for latching closed.

6. A tool and accessory box for use on a ladder comprising:

a container body having a plurality of side walls and a floor, joined together, and a removable and openable lid, said lid movable between an open position to access an interior of said container body, and a closed position to form an essentially horizontal platform;

a pair of elongated support members, each of said pair of elongated support members including a plurality of evenly spaced downward facing wedged shaped protruding members, each of said plurality of evenly spaced wedged shaped protruding members manually movable to a nonprotruding position essentially flush with a surface of each of said elongated support members, each of said plurality of evenly spaced wedged shaped protruding members being biased in the protruding position;

a pair of mounting brackets, each of said pair of mounting brackets including means for attaching to a side of a ladder, each of said pair of mounting brackets further including an essentially vertical aperture sized to receive one of said elongated support members, each of said mounting bracket essentially vertical apertures including at least one fixed horizontal portion positioned to engage a lower edge of each of said wedge shaped protruding members to adjustably position each of said elongated support members in a plurality of fixed positions in relation to each of said mounting brackets;

each of said elongated support members being slidable in relation to each of said mounting brackets when each of said plurality of said wedged shaped protruding members are manually moved to said flush position when adjacent said at least one fixed horizontal portion of said essentially vertical aperture;

said container body including a pair of apertures sized and positioned to receive one each of said pair of elongated support members;

each of said pair of elongated support members having a prepositioned shoulder to support said container body when said elongated support members are received within said pair of apertures on said container body;

wherein said plurality of fixed positions of each of said elongated support members within each of said mounting bracket essentially vertical apertures provides a plurality of height positions for said container body relative to the ladder;

a removable horizontal bar or tubular member attachable at each end by a prepositioned bracket on each of said pair of elongated support members whereby a roll of paper towels can be hung in a convenient location, removable by raising one end up and sliding out to one side through access hole in support member.

7. A tool and accessory box as in claim 1 wherein said container body includes a handle.

8. A tool and accessory box as in claim 1 wherein said container body includes at least one external means for holding a tool.

* * * * *